United States Patent [19]

Takizawa et al.

[11] Patent Number: 4,665,406

[45] Date of Patent: May 12, 1987

[54] MECHANISM FOR EXTENDING AND CONTRACTING ANTENNA

[75] Inventors: Akio Takizawa, Tokyo; Mitsuhiro Suga, Ageo; Syozo Saito, Okegawa, all of Japan

[73] Assignee: Nippon Antenna Kabushiki Kaisha, Tokyo, Japan

[21] Appl. No.: 734,103

[22] Filed: May 15, 1985

[30] Foreign Application Priority Data

May 16, 1984 [JP] Japan ..... 59-70259
Mar. 29, 1985 [JP] Japan ..... 60-63736

[51] Int. Cl.[4] ..... H01Q 1/10
[52] U.S. Cl. ..... 343/903; 343/714
[58] Field of Search ..... 343/903, 901, 877, 714; 242/54 A

[56] References Cited

U.S. PATENT DOCUMENTS

| | | | |
|---|---|---|---|
| 2,420,772 | 5/1947 | Dalton | 343/903 |
| 2,617,933 | 11/1952 | Noel | 343/714 |
| 2,623,175 | 12/1952 | Finke | 343/903 |
| 2,695,957 | 11/1954 | Cone | 343/714 |
| 2,797,413 | 6/1957 | Cone | 343/714 |
| 2,834,012 | 5/1958 | Allen | 343/877 |
| 3,146,450 | 8/1964 | Dooner | 343/903 |
| 3,273,813 | 9/1966 | George | 242/54 A |
| 3,728,906 | 4/1973 | Takaki et al. | 343/877 |
| 4,181,268 | 1/1980 | Carolus et al. | 343/903 |
| 4,190,841 | 2/1980 | Harada | 343/901 |
| 4,190,842 | 2/1980 | Carolus et al. | 343/903 |
| 4,426,650 | 1/1984 | Korsen | 343/903 |
| 4,542,383 | 9/1985 | Cusey et al. | 343/903 |

FOREIGN PATENT DOCUMENTS

| | | | |
|---|---|---|---|
| 570063 | 2/1959 | Canada | 343/903 |
| 511925 | of 1955 | Italy | 343/903 |
| 4417923 | 9/1965 | Japan | 343/903 |
| 51-49942 | 4/1976 | Japan . | |
| 155033 | 12/1976 | Japan . | |
| 0016948 | 2/1977 | Japan | 343/903 |
| 53-29047 | 3/1978 | Japan . | |
| 54-90951 | 7/1979 | Japan . | |
| 54-36613 | 11/1979 | Japan . | |
| 56-31044 | 7/1981 | Japan . | |
| 306208 | 3/1955 | Switzerland | 343/877 |
| 1223614 | 2/1971 | United Kingdom | 343/903 |

*Primary Examiner*—Charles Frankfort
*Assistant Examiner*—Thomas B. Will
*Attorney, Agent, or Firm*—Birch, Stewart, Kolasch & Birch

[57] ABSTRACT

An antenna system is provided with a plurality of telescoped antenna sections which are extended and contracted by an operating wire connected to the uppermost antenna section. The wire is made of a relatively rigid material and has a width of 1.5~2.2 times its thickness. There is also provided a clutch for selectively operating the antenna by a motor or the human hand.

24 Claims, 21 Drawing Figures

PRIOR ART

MECHANISM FOR EXTENDING AND CONTRACTING ANTENNA

BACKGROUND OF THE INVENTION

The present invention relates to a mechanism for extending and contracting an antenna, and more particularly a mechanism for manually or automatically extending and contracting an antenna, for example a telescope type antenna.

As is well known, a telescope type antenna is constituted by a plurality of tubes having different diameters which are interconnected like a telescope. The antenna is extended or contracted by using a wire which does not extend and contract. The wire utilized for this purpose has a circular cross-sectional configuration. It is advantageous that the wire is straight when the antenna is extended. A synthetic resin, for example a polyacetal resin, is suitable to form an operating wire having a circular cross-section.

In recent years, a gear is used for extending and contracting the operating wire. In this case, the gear is situated at a wire passing port provided for a casing containing a drum or at a position just below an antenna base cylinder mounting portion. The gear is driven by an electric motor and a rack is provided for engaging the gear. Special constructions for driving the gear are disclosed in Japanese Utility Model Laid Open Patent Specification Nos. 49,942/1974, 155,033/1971 and 36,613/1979. In these references, a strip member or the like is substituted for a wire driven by the gear, and perforations are provided for the strip member for engaging the gear. Furthermore, Japanese Laid Open Patent Specification No. 29,047/1978 discloses a plastic belt clamped between rollers to be extended and contracted by driving the rollers.

According to Japanese Laid Open Patent Specification No. 90,951/1979, a gear is formed on periphery of a large diameter pulley contained in a casing, and driven by an electric motor, and a wire push member is provided in a range of 90° in the peripheral direction of said pulley starting from a position immediately beneath an antenna base cylinder, that is an antenna receiving cylinder. Furthermore, a rack is formed on one side of said wire so as to mesh the rack with the gear provided for the pulley. This reference also shows a construction wherein the rear surface of the wire push member is made flat so as to efficiently guide the wire push member.

Further, Japanese Utility Model Laid Open Patent Specification No. 31,044/1981 discloses a flat rectangular wire which is substituted for a conventional wire having a circular cross-section for the purpose of neatly accommodating an antenna operating wire in a casing. Since this wire is intended to substitute for a conventional circular wire, its cross-sectional configuration is approximately square.

As is well known, the extending and contracting antenna is frequently used in motor cars. Such car mounted antenna is extended and contracted by manual operation or automatic operation utilizing an electric motor. The manual operation has been used for many years. With the motor operation, the antenna can be extended and contracted by operating a switch installed in a car. Especially, it is convenient when the antenna is expanded and contracted in an interlocked relation with the ON·OFF operation of a car radio switch and when it rains, the driver is not required to get out of the car for manipulating the antenna. Actually, however, the driver may often get out of the car without contracting the antenna. In such a case, the driver must enter again into the car for operating a switch so as to contract the antenna. For manually or automatically extending and contracting the antenna various proposals have been made. For example, where a multithread worm is used, it can be driven by manual operation and an electric motor. According to another proposal, a planet wheel mechanism is controlled by an electromagnet for extending and contracting the antenna.

As above described, according to the prior art construction, an antenna operating member is made of a noncontractive linear synthetic resin wound about a rotary drum. Thus, the antenna is extended and contracted by the rotation of the drum through the antenna operating member. Accordingly, not only the drum diameter is increased but also the resistance to paying out and taking up of the antenna operating element having a relatively large resistance is increased. For this reason, the size of the antenna extending and contracting mechanism is determined by the diameter of the drum, meaning an increase in the capacity of the motor. The wire is payed out while being strongly urged against the inner surface of the drum or the surface of the winding groove (which is arcuate for receiving the wire having a circular cross-section). But the wire tends to slide along the inner surface of the drum or of the winding drum, while being inclined thereto. Thus, the pay out efficiency caused by a push force decreases substantially. Slipping of the wire while being urged against the inner surface of the drum or the surface of the winding groove means pushing out the wire from the rotatably mounted drum toward a stationary base member which causes the periphery of the drum to move away from the base member. According to operating conditions (especially, when the drum is not clutched off after it has reached the paying out limit or when the telescope type antenna is frozen in a cold season) the wire would be pushed in between the drum and the base member like a wedge, thus disenabling the rotation of the drum in either direction. Furthermore, the wire would be twisted helically in an opening through the antenna base cylinder, thus breaking the wire.

In a construction utilizing a gear and if a rack and the operating member is payed out and taken up by the gear driven by a motor, the disadvantages described above can be obviated. However, in this construction, the mechanism for driving the gear with the motor becomes bulky. In a press molded rack or strip shaped rack formed with openings for engaging the gear, the longitudinal strength of the rack is small, thus failing to achieve a smooth extension and contraction of the antenna. Especially, a strip shaped rack has a tendency to bend thus failing to obtain optimum extension and contraction. In a construction where a plastic belt is clamped between opposing rollers, not only the construction becomes complicated but also the above described disadvantage of the strip shaped member can not be obviated.

In the construction disclosed in Japanese Laid Open Patent Specification No. 90,951/1979, since a relatively long wire is payed out or taken up by the rotation of a pulley while being strongly urged against a stationary guide member, the friction between the wire and the guide member increases, thus disenabling smooth extension and contraction. Especially when the rear surface of the wire opposing the rack is made flat, these members contact with each other with a relatively large area thus increasing the friction therebetween. Especially in a strip formed with a rack or holes for engaging a gear, not only the number of the manufacturing steps increases but also sufficiently large longitudinal strength can not be obtained. For this reason, the cross-sectional area of the strip increases.

The operating wire disclosed in Japanese Laid Open Utility Model Specification No. 31,044/1981 has substantially square cross-section. Although it can be neatly taken up in a drum, in the taken up state, the wire tends to bend in the circumferential direction of the drum so that the taken up state of the wire is not always stable. Accordingly, the push up force of the antenna and the extending and contracting characteristics are similar to a circular wire whereby smooth take up and miniaturization of the mechanism are difficult.

Where a multithread worm is used for manually or automatically extending and contracting the antenna, the advantage of a low speed drive is decreased. Further, it is necessary to provide another speed reduction mechanism between the worm and the take up drum thereby increasing the capacity of the motor. When the motor operated system is operated manually, the motor operates as a generator so that it is necessary to provide a protective device for the source of the motor. A mechanism utilizing plat gears is required to be incorporated with a permanent magnet and a control switch for ON-OFF controlling the permanent magnet at a suitable timing. In each case, for preventing excessive load applied to the operating wire at the limits of extension and contraction of the antenna, it is necessary to provide a clutch mechanism for releasing the same when an overload condition occurs. As above explained, the construction of the prior art manual or motor operated antenna extending and contracting mechanism is complicated and its cost of manufacturing is high.

SUMMARY OF THE INVENTION

It is an object of the present invention to provide an improved antenna extending and contracting mechanism utilizing a new type antenna operating wire capable of being helically or spirally wound on a take-up drum but having sufficient rigidity for transmitting a push out power to the antenna without bending.

Another object of the present invention is to provide an improved antenna extending and contracting mechanism including a clutch enabling the antenna to be contracted and extended by an electric motor or by man power.

Further scope of applicablity of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

According to the present invention, there is provided an antenna extending and contracting mechanism of the type comprising a rotary drum for taking up and paying out a relatively rigid wire for extracting and contracting the antenna, an electric motor for driving the rotary drum, the antenna being made up of a plurality of telescoped antenna sections, an antenna base cylinder accommodating the sections when the antenna is contracted, a base member for supporting the rotary drum, the motor and the antenna, clutch means incorporated into a motion transmission system between the motor and the rotary drum, characterized in that the wire has a flat rectangular sectional configuration having a width of 1.5~2.2 times of a thickness, and one end of the wire is connected to the uppermost antenna section through the antenna base cylinder, and wherein guide means for receiving opposite ends of the wire in the width direction thereof is interposed between the antenna base cylinder and the rotary drum, the rotary drum being provided with means for edgewisely taking up the wire.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

The present invention is characterized by an antenna operating wire utilized to extend and contract the antenna. As shown in the accompanying drawing, the wire 1 is made of such hard synthetic resin as polyacetal resin which does not extend or contract and becomes straight when released. The wire has a rectangular or similar cross-sectional configuration having a width W and a thickness t. The side surfaces 13 between opposing flat surfaces 12 or 12*a* may be arcuate.

Figure 1:
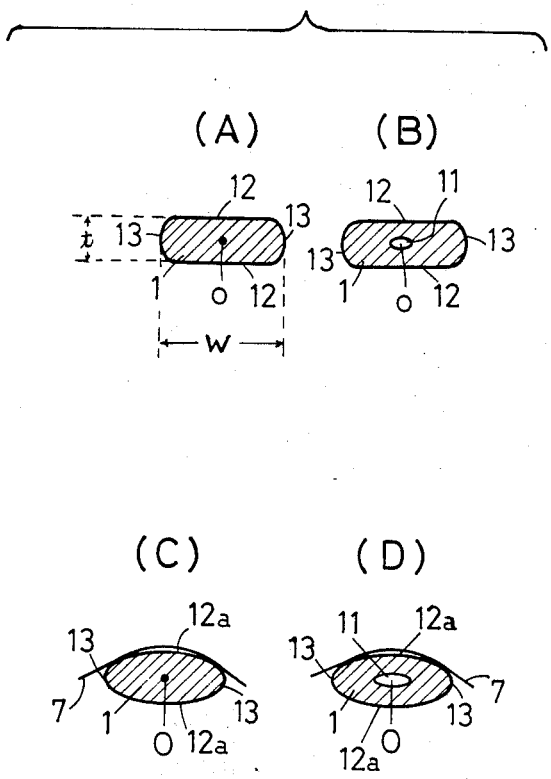
FIGS. 1A through 1D show certain examples of the cross-sectional configuration of the antenna operating wires embodying the present invention.

The wires shown in FIGS. 1A and 1B have flat surfaces while the wires shown in FIGS. 1C and 1D have slightly convexed surfaces 12*a*. Irrespective of these configurations, the width of the wire should be large such that the arcuate side portions 13 will make intimate contacts with the inner surface of the base cylinder 7 of the antenna, or that the interfaces between the flat surfaces 12 or 12*a* and the arcuate side portions 13 would make line contacts against the inner surface of the antenna base cylinder in the axial direction of the wire 1. When the flat surfaces 12 are slightly convexed as shown by 12*a* in FIGS. 1C and 1D, extraction of the wire 1 becomes easy. However, the radius of the convexed surface should not be smaller than the radius of the inner surface of the base cylinder 7. The flat surfaces 12 and the slightly convexed surfaces 12*a* are not required to be always smooth and may be slightly irregular.

Figure 7:
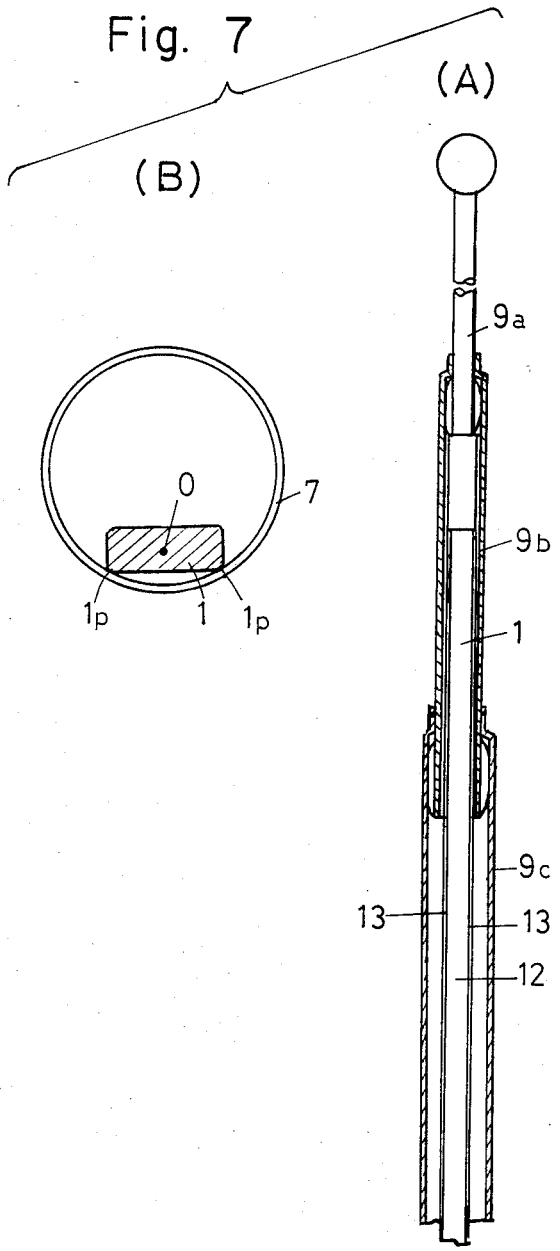
FIG. 7A is a longitudinal, sectional view showing the state of inserting the wire into an antenna.
FIG. 7B is a cross-sectional view of the assembly shown in FIG. 7A.

A plurality of telescoped tubular antenna sections 9*a*~9*n* are made of metals and have different diameters. When extended these sections constitute a multisection transmitting or receiving antenna. All of these antenna sections are accommodated in the antenna base cylinder 7 when they are contracted. Of course, the inner diameter of each antenna section is smaller than that of the antenna base cylinder 7. When the wire 1 positioned in the antenna sections and the antenna base cylinder 7 as shown in FIG. 7B is subjected to a push out force, and as a result, when the wire flexes, the opposite sides of the wire would make line contacts with respective antenna sections. As shown in FIG. 7B, since the outer portions of such line contacts cooperate with the circular inner surface of the antenna base cylinder to form steeply inclined surfaces that prevent slip of the wire 1, sliding of the wire along the circular surface in any direction can be efficiently prevented. For this reason, even when a substantially large push out force is applied, the wire is held in a predetermined aligned position so that the push out force applied acts exclusively as upward push out force, thus ensuring accurate extension of the antenna. When applied with a push out force the conventional wire of a circular cross-sectional configuration will bend so that it makes a single line contact with the inner surface of the antenna base cylinder in a plane including the axis of the wire. Such single line contact requires stronger push out force, and a wire which bends in any arbitrary direction is caused to readily slide in the lateral direction by a force applied after the antenna has completely been extended, whereby the wire would bend wavy or spirally in the antenna base cylinder. Such bending of the wire in the antenna sections greatly reduces the push out force. Such decreased push out force merely acts as a bending force of the wire, thus degrading and breaking the wire. Moreover, it becomes difficult to obtain an accurate extended length proportional to the amount of rotation of a motor driven pay out drum. According to the present invention, since it is possible to efficiently prevent slip of the wire towards the lateral side of the contact point on the inner surface of the antenna base cylinder, a positive push out force can be obtained and the amount of extension becomes proportional to the amount of rotation of the motor or drum.

The central portion 0 of the wire may take the form of a small opening 11 as shown in FIGS. 1B and 1D.

Figure 2:
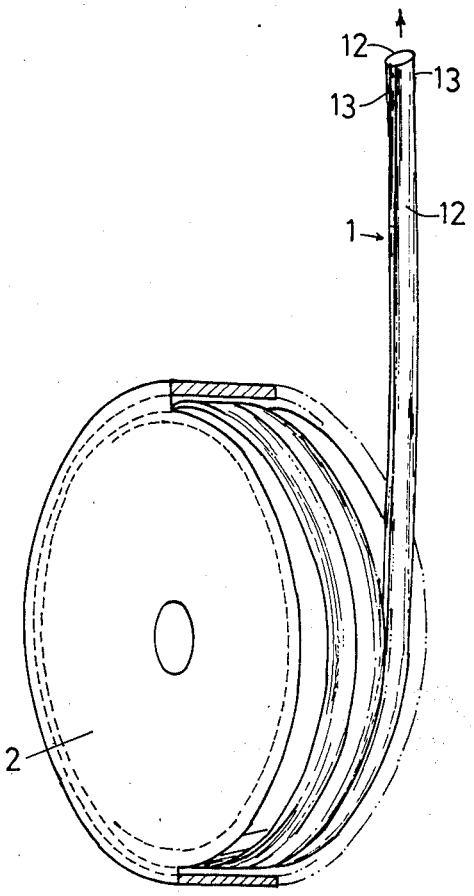
FIGS. 2 and 3 are perspective views showing the states of taking-up or winding up the wire.
Figure 3:
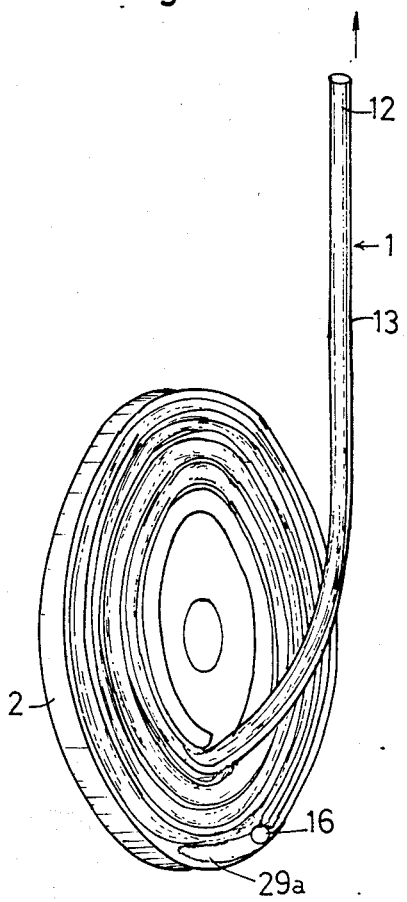

The antenna operating wire 1 is taken up or wound about a drum shaped take-up rotary drum 2. The wire can be taken up spirally as shown in FIG. 3 or helically as shown in FIG. 2. The wire taken up in this manner is contained in a casing 3 shown in FIGS. 4 or 5 and the drum is rotated by an electric motor 4. The take-up drum 2 is secured coaxially with a motor driven worm wheel 5 and rotated integrally with the worm wheel 5 by the pressure applied by a clutch mechanism 6. As the pressure applied by the clutch mechanism is released, only the worm wheel 5 rotates.

Figure 10:
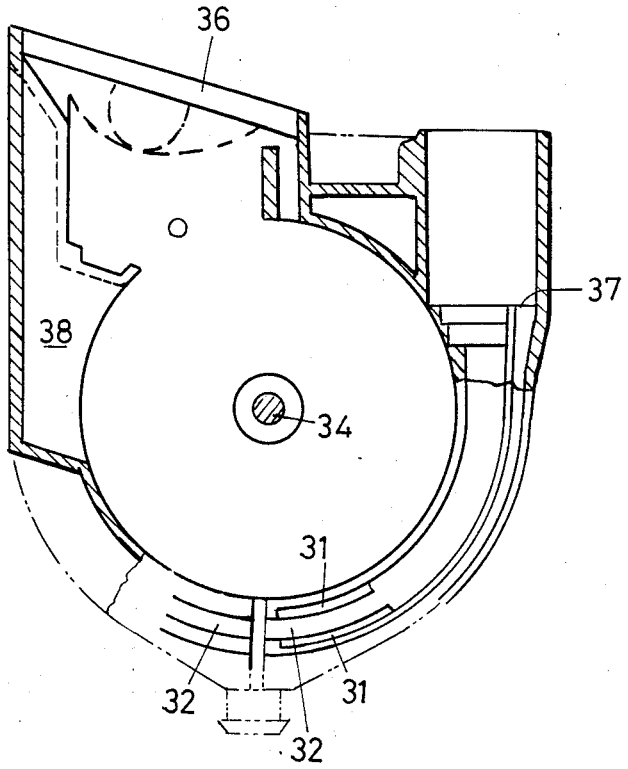
FIG. 10 in a cross-sectional view of the base member shown in FIG. 4.

The wire 1 extends into the antenna base cylinder 7 and is connected to the uppermost one of the antenna sections having different diameters, so as to extend and contract the antenna sections by the forward and reverse rotation of the motor. Between the take-up drum 2 and the antenna base cylinder 7 is disposed a guide member which guides the wire into the take-up drum while spirally or helically bending the wire. As shown in FIG. 10, in this invention utilizing a flat wire 1, the guide member is provided with an inclined guide surface 31 on the side of the take-up drum 2 and a groove 32 formed at the central portion of the inclined guide surface 31 for receiving one end of the flat wire 1. Since annular wire receiving groove 29 is provided for the inner periphery of the take-up drum 2 the groove 29 can receive the other end of the flat wire 1. The groove 29 has the same width as the groove 32.

Figure 4:
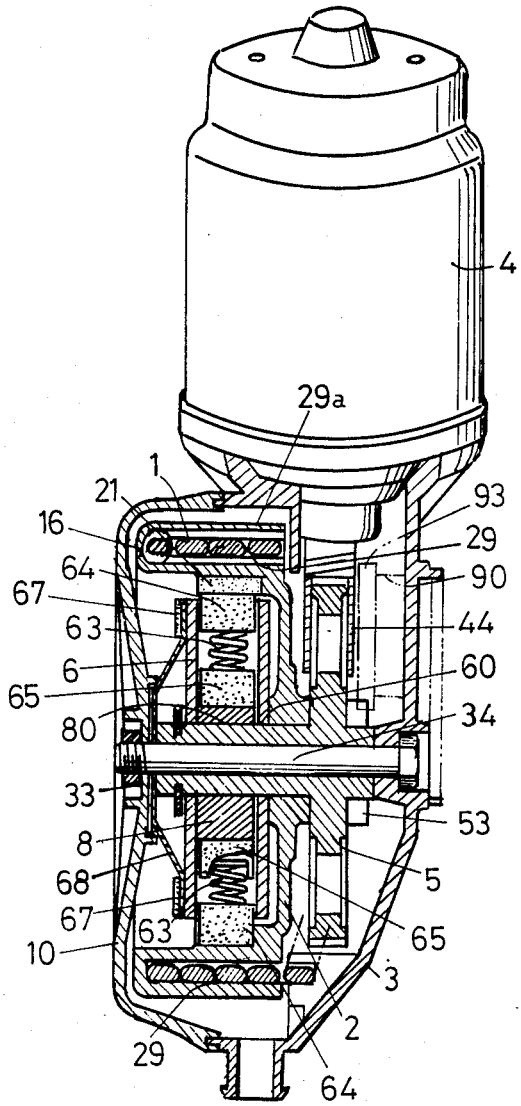
FIG. 4 is a side view, partly in section, showing an antenna extension and contraction mechanism having a rotary take-up drum of the type shown in FIG. 3.
Figure 5:
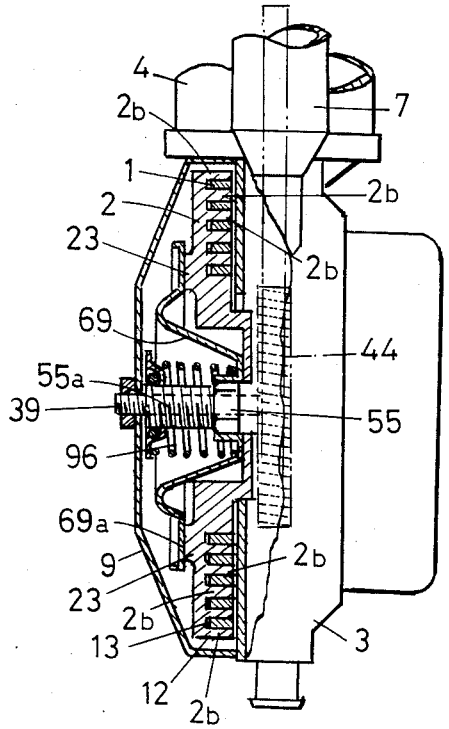
FIG. 5 is a side view, partly in section, showing an antenna extension and contraction mechanism having a rotary take-up drum of the type shown in FIG. 2.
Figure 11:
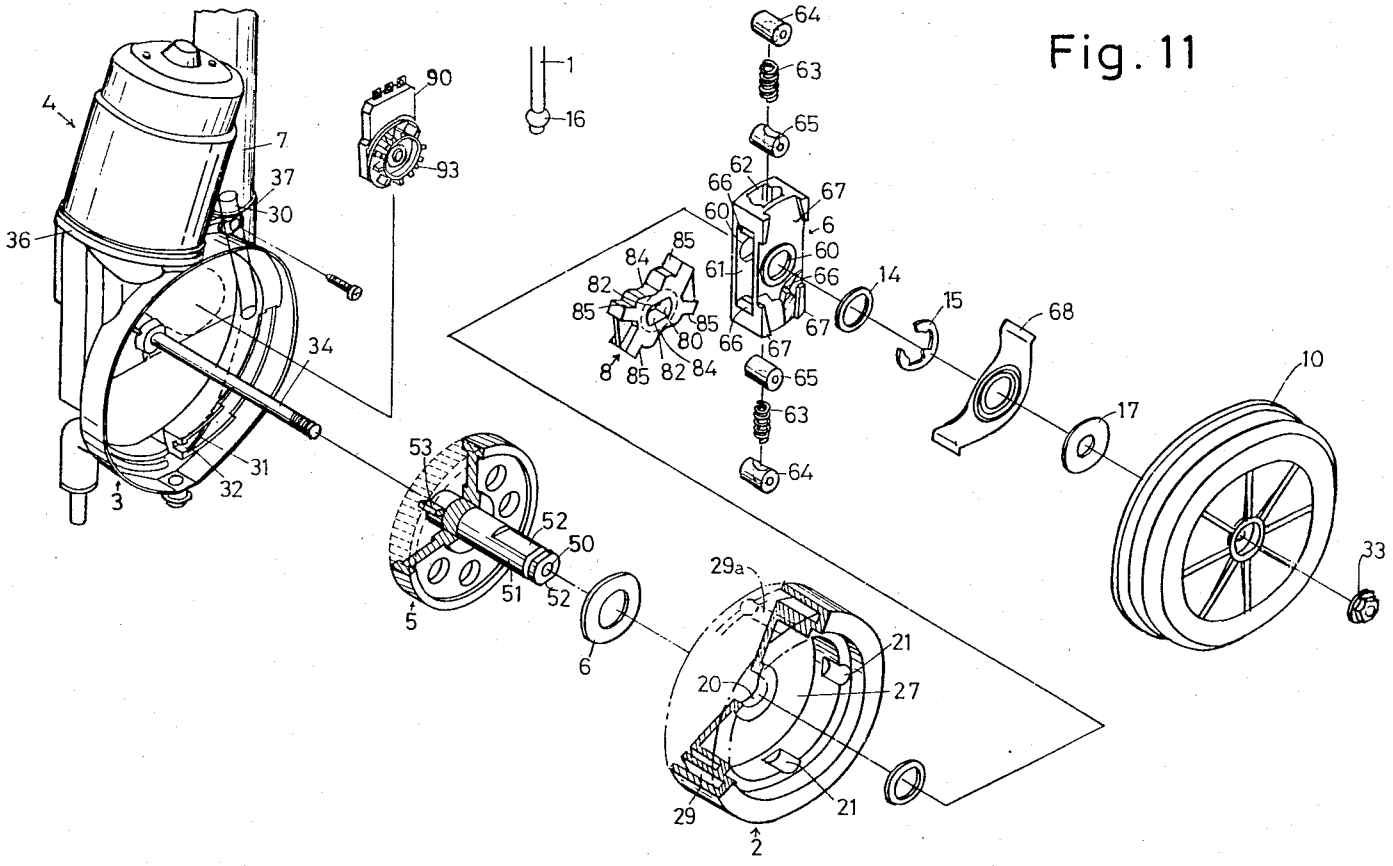
FIG. 11 is an exploded perspective view of the mechanism shown in FIG. 4.

Until the leading end of the flat wire 1 which is guided to the inclined guide surface 31 through a perforation 30 at the bottom of the antenna base cylinder 7 reaches the inclined guide surface 31, the flat surfaces 12 are not in any specific direction, but as the leading end of the wire 1 is bent toward the wire receiving groove 29 by the inclined guide surface, due to the large resistance to the bending in the direction of the width of the wire, the bending of the wire is limited to its thickness direction so that one of the flat surfaces 12 is received in the receiving groove 29 while the other is received in the receiving groove 32. Since the flat surfaces 12 are parallel to the periphery of the take-up drum 2, the above described guide operation makes easy winding of the wire. Since the wire 1 is made of a polyacetal resin, the wire tends to slip on the inclined guide surface 31 and in the receiving groove 29 of the take-up drum 2 and as a result the receiving of the leading end of the wire can be smoothly effected. Once the leading end is correctly received, pay out and take up of the wire from and onto the rotary drum can be effected neatly and smoothly. In the embodiment shown in FIGS. 4 and 11, a ball 16 is secured to the leading end of the wire 1, and a circular enlarged groove 29*a* shown by dotted lines in FIG. 11 is formed at one portion of the receiving groove 29 to extend in the direction of the depth thereof, that is, the width direction of the take-up drum. At the time of inserting the leading end of the wire, the engaging member slides along the inclined guide surface 31 to reach the entrance of the circular enlarged groove 29*a*. During acceptance of the engaging member, the wire 1 is bent in its thickness direction, and moreover since one of the flat surfaces 12 engages the opening end of the receiving groove of the take-up drum 2, the rolling of the engaging member becomes easy, whereby the receiving of the flat wire in the receiving grooves 29 and 32 becomes more smooth. Furthermore the ball 16 received in the enlarged groove 29*a* is pushed into a deep portion as the amount of the wire taken up increases, with the result that the entire length of the wire 1 can be neatly received in the receiving groove 29, as shown in FIG. 4. When the direction of rotation of the take-up drum 2 is reversed to pay out the wire 1, the ball 16 leaves the inclined guide surface and pulls the antenna into the cylinder 7. However, since the length of the wire is somewhat longer than the extended length of the antenna, even when the rotation of the drum 2 is stopped, when the antenna is perfectly extended, the leading end of the wire 1, that is ball 16, always maintains engagement with the circular enlarged groove 29*a*.

We have found that a thickness to width ratio of 1.5~2.2 is advantageous for a flat operating wire made of a polyacetal resin or the like. When this ratio is less than 1.5, where the wire has an elliptical sectional configuration as shown in FIGS. 1C and 1D. The advantage of flat wire wherein the direction of bending is specified, can not be attained. On the other hand, where the thickness to width ratio exceeds 2.2, the wire become a strip or tape so that its antenna section push out force decreases. In other words, when applied with the push out force, the wire tends to bend into a complicated shape, thus losing the property of a rigid wire. Provision of an opening at the central portion of the wire does not affect the push out force of the wire so long as the radius of the opening is less than several % of the radius of the opening.

Figure 8:
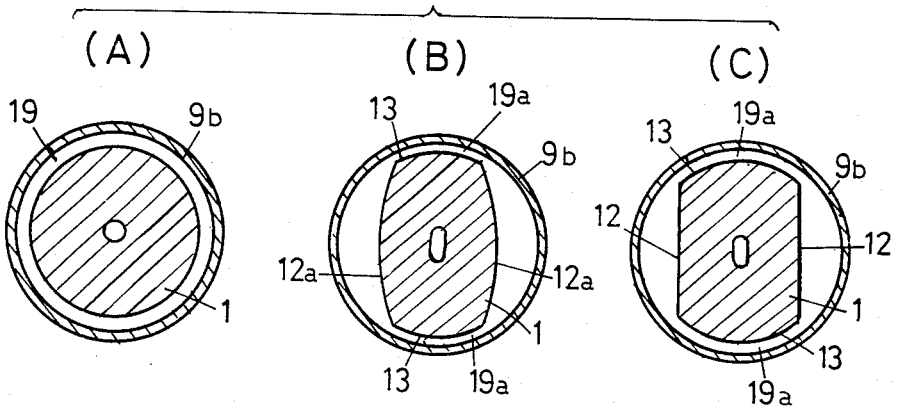
FIGS. 8A, 8B and 8C are enlarged cross-sectional views comparing the positions of the wire in the antenna of the present invention and of the prior arts.

FIGS. 7A, 7B, 8A, FIGS. 8B and 8C show the relationship between the cross-sectional configuration of the wire and the multi-section antenna. As is well known in the art, one end of wire 1 is connected to the uppermost section 9*a* of the antenna sections 9*a*, 9*b* . . . 9*n*. The uppermost section 9*a* is telescopely received in the second and succeeding sections. FIG. 8A shows a cross-sectional view utilizing a prior art or circular wire 1. In this case, the gap 19 between the wire 1 and the second antenna section 9*b* is relatively large, whereas in FIGS. 9B and 9C utilizing a flat wire 1 of the present invention, the gap 19*a* between the arcuate ends 13 of the wire and the second antenna section 9*b* is very small. Actually, the cross-antenna sectional area (or diameter) of the wire is limited by the inner diameter of the second antenna section 9*b*. In a multisection rod antenna now being used the inner diameter of the second antenna section 9*b* generally lies in a range of 4.3~4.5 mm so that the diameter or width of the wire 1 can not exceed the inner diameter of the second section. The load necessary for bending the flat wire of this invention having a width to thickness ratio of 1.5 in a direction parallel to flat surface amounts to about 3 times of the load necessary for bending a prior art round wire (shown in FIG. 8A) having a diameter of about 4 mm, made of polyacetal resin and bent with a radius of 4 cm. Such multiplying factor increases with the degree of flatness. As above described since the width of the wire is limited by the inner diameter of the second antenna section 9*b*, an increase in the ratio W/t means a decrease in t. A decrease in t decreases the strength of the wire. For this reason, it is impossible to make extremely large the ratio W/t so that about 2.2 is the upper limit.

Figure 9:
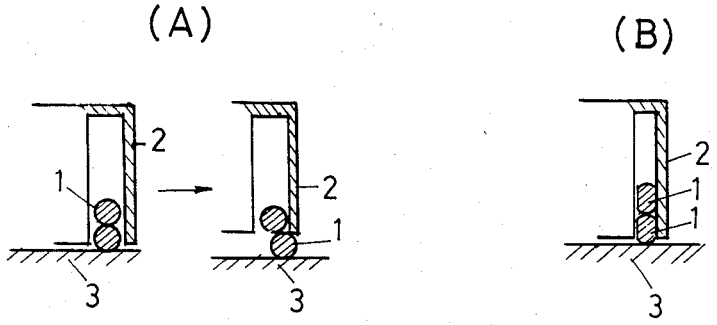
PRIOR ART Fig. 9
FIGS. 9A, 9B and 9C are partial sectional views showing the protruding of the wire from a space between the take-up rotary drum of the base member of the present invention and of the prior art.

As shown in FIGS. 2~6, the flat wire of this invention is received between supporting walls 2*b* provided for the take-up drum 2. Since the wire 1 is flat, in each of the cases shown in FIGS. 2~6, the gap between adjacent supporting walls 2*b* is relatively narrow. At the time of paying out and taking up, the flat surfaces 12 engage the supporting walls 2*b*, whereas at the time of pushing out the antenna sections, the flat surfaces engage the supporting walls on the radially inner wall. At the time of taking up for contracting the antenna, the flat surfaces engage the supporting walls on the radially inner side. The flat surfaces stably engages the supporting walls 2*b* and do not accompany slips along inclined surfaces which occurs when the wire has a circular cross-section. Consequently as shown in FIGS. 9A and 9B, even when the wire is urged against the outer supporting wall for producing a push out force (especially when the clutch is operated) the wire would not be clamped between the drum and base member as shown in FIG. 9A nor will the wire bends spirally in the antenna base cylinder.

The clutch mechanism (shown in FIG. 5) incorporated between the worm wheel 5 and the take-up drum 2 in the base member 3 comprises a clutch plate 69 resiliently urged by a resilient member 96 against the take-up drum 2 rotatably supported by the base member 3. A projection 69*a* on the periphery of the clutch plate 69 engages a projection provided for the take-up drum 23. The clutch plate 69 is mounted on a square shaft 55 of a worm wheel (not shown) meshing with worm 44 driven by an electric motor. Consequently, in a case wherein the take-up drum 2 is stopped when the shaft 55 of the worm wheel is rotated with a force larger than a predetermined clutch force, projection 69*a* disengages from projection 23, thus releasing the clutch. The square shaft 55 and a threaded shaft 55*a* integral therewith are formed with an inner bore to receive a mounting shaft of the base member 3 for mounting a cover member 9.

A special clutch mechanism and elements associated therewith which are suitable for extending and contracting the antenna by utilizing the characteristics of the wire are shown in FIGS. 4, 11, 6 and 12. More particularly, a shaft 34 is secured to the central portion of the base portion 3 and the mounting seat 37 of the antenna base cylinder 7 and the mounting seat 36 of the motor 4 are provided for the upper portion of the base member 3, and a small worm wheel 35 meshing with the worm wheel 5 is secured to the lower surface of the mounting seat 36. A worm 44 driven by motor 4 meshes with the worm wheel 5. Where a small motor 4*a* is secured to the mounting seat 36 instead of motor 4, a worm 44*a* driven by the small motor 4*a* drives the worm wheel 5 via a small worm wheel 35. More particularly, where motor 4 is used as shown in FIG. 12A, and where a small motor 4*a* is used as shown in FIG. 12B, the worm wheel 5 can be driven efficiently. In the antenna extending and contracting mechanism constituted by the base member 3, the take-up drum 2 and the worm wheel 5 which are made of a synthetic resin, the weight of the motor 4 is the maximum so that when a small motor 4*a* is used the weight of the mechanism can be reduced substantially. In recent years, it is strongly desired to decrease the weight and size of the parts of motor cars. Thus the mechanism just described can meet these requirements. The clutch mechanism utilized in this invention will now be described with reference to FIGS. 4 and 11. Thus the mounting shaft 34 is received in an opening 50 provided for the worm wheel 5 and the shaft 51 thereof. Engaging surfaces are formed on one end of shaft 51 for engaging with the engaging surfaces 82 provided for an opening 80 of a rotating member 8 (to be described later) so as to be slidable in the axial direction but to rotate integrally. The shaft opening 20 of the take-up drum 2 is fitted on the base end of the shaft 51. The rotary member 8 and the clutch member 6 are amounted on the engaging surfaces 52 in a chamber 27 on the inside of the receiving groove 29 of the take-up drum thus fitted. Thus, a circular shaft openings 60 are provided for the rectangular clutch member 6. An opening 61 for receiving the rotary member 8 is defined between opposing sides of the clutch member 6. The substantially rectangular rotary member 8 is assembled to cross the clutch member 6. The engaging surfaces 82 of an opening 80 for receiving the rotary member 8 are caused to engage the engaging surfaces 52 so as to transmit the torque of the worm wheel 5 to the rotary member 8. Valley shaped cams 84 are formed at the centers of the side surfaces of the rotary member 8 and inclined engaging members 85 adapted to engage projections 66 on the upper and lower sides of the shaft opening 60 of the clutch member 6 are formed on both sides of the valley shaped cams 84. The shorter end surfaces of the clutch member 6 are provided with opposing openings 62 in which a pair of engaging members 64 and 65 interconnected through a coil spring 63 are fitted respectively. The inner members 65 are received in the valley shaped cams 84, while the outer members 64 are caused to engage and disengage a plurality of recesses formed on the side surface of the chamber 27 of the drum.

A washer 14 and a E ring 15 are mounted on the shaft 34 of the base member 3 mounted with the worm wheel 5, the take-up drum 2, the clutch member 6 and the rotary member 8 and a leaf spring 68 is caused to engage inclined portions 67 formed on the opposite surfaces of the clutch member 6. A frictional force of the leaf spring 68 created by a nut 33 (see FIG. 4) threaded on the shaft 34 is applied between the clutch member 6 and the take-up drum 2 so as to make different the rotations of the rotary member 5 and the clutch member 6.

Figure 6:
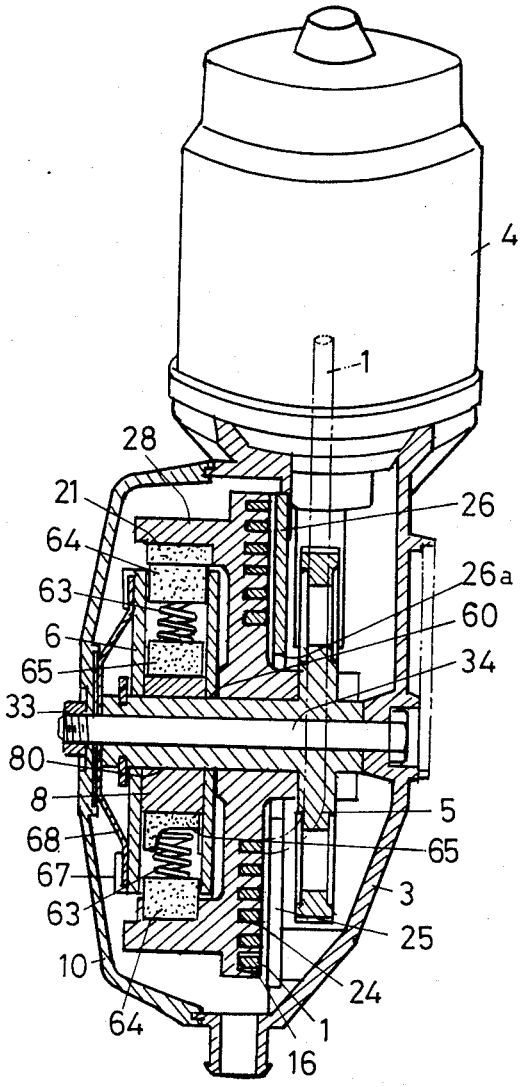
FIG. 6 is a longitudinal sectional view showing a modified embodiment of FIG. 5.

The clutch mechanism described above can also be applied to a take-up drum which spirally takes up the wire as shown in FIGS. 3 and 6. More particularly, a spiral wire receiving groove 24 is formed on one surface of a plate shaped rotary member 2 and an annular projection 28 is formed on the other side of the rotary member 2 to define a chamber 27 for receiving the clutch member 6, and the rotary member 8 in the same manner as that shown in FIG. 4. A partition plate 26 having a center opening 26*a* for passing the shaft is disposed between the base member 3 and the take-up drum 2 at the opening of the spiral wire receiving groove 24. The partition plate 26 is formed with a radially extending wire admitting notch 25 over the entire range in which the wire receiving slot 24 is formed. Thus, one end of wire 1 led from the antenna base cylinder 7 is connected to the drum 2 through the notch 25.

A switch mechanism may be provided for automatically controlling the motor. Such switch mechanism is designated by 90 in FIG. 11 and provided with a rotary member 93 in the form of a gear 93 that engages projections 53 on the rear surface of the worm wheel 5. As the gear shaped rotary member 93 intermittently rotates by engaging the projections 53 so as to transmit the rotation of the worm wheel 5 imparted by motor 4 to the swtich mechanism 90 for ON·OFF controlling the stop signal of the motor 4. Such mechanism can be used for a case wherein the antenna is extended and contracted by the operation of a car switch (that is an engine switch) or a radio switch and the motor is stopped at the limits of extension and contraction of the antenna.

Figure 12:
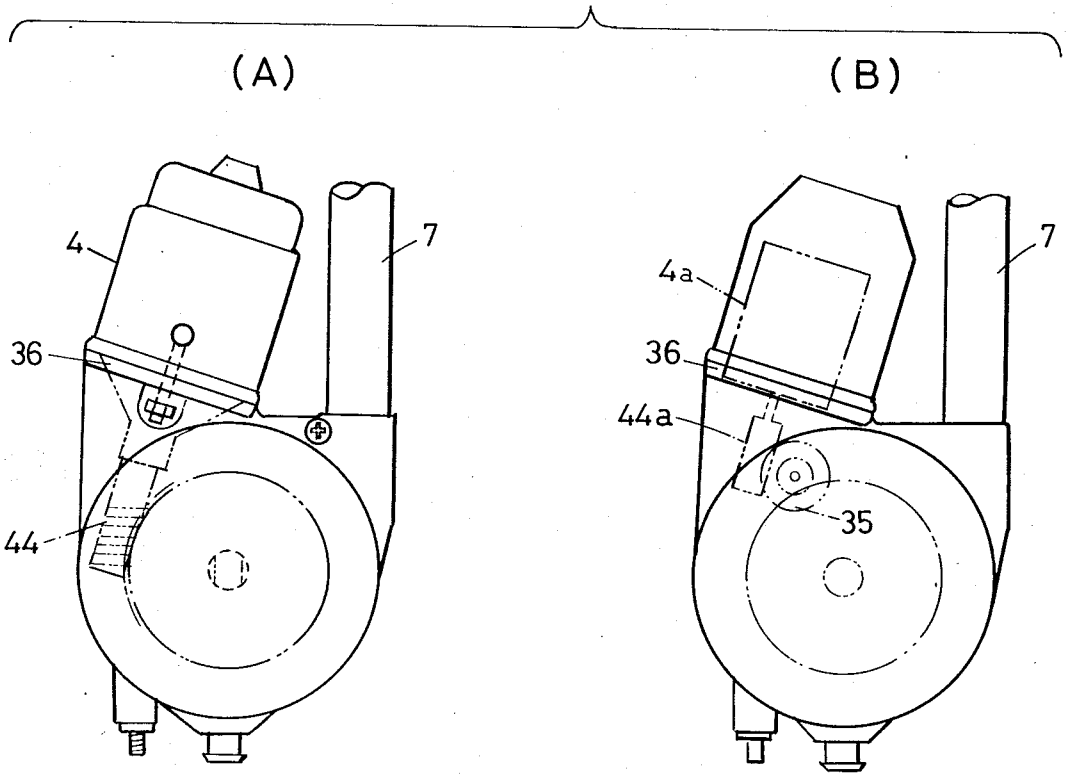
FIGS. 12A and 12B are plan views showing the manner of mounting an alternative motor to a motor mounting seat.

In the embodiment shown in FIGS. 4 and 11, the construction of the extending and contracting mechanism including the motor can be made compact, the base member thereof being shown in FIG. 10. According to this invention, since a flat wire 1 is used, the diameter of the take-up drum 2 can be made small. Hence the diameters of the base member 3 and the cover 10 can also be reduced. The motor mounting seat 36 formed at one side of the upper portion of the base member 3 is inclined toward the other side of the base member so that the motor 4 or 4*a* mounted on such mounting seat 36 inclines towards the antenna base cylinder as shown in FIG. 12, whereby the motor 4 is mounted in the reduced diameter range of the base member 3. An inner space 38 in the mounting space 36 can be formed by stamping the base portion 3 formed integrally at right angles with respect to a reference surface of the base member 3, for example the mounting surface 37 of the antenna base cylinder. Since the motor 4 is positioned in a range of the diameter of the reduced diameter base member 3, the construction of the automatic antenna extending and contracting mechanism can be made to be compact, thereby facilitating the mounting of the mechanism on a car, which also decreases the volume of the packed mechanism. Generally stated, in the mechanism of this type, a portion having a length nearly equal to the radius of the motor projects beyond the range of the diameter of the base member 3. For example, in FIG. 12A when worm 44 is caused to engage worm wheel 5 on the outside thereof and in a vertical position, a portion of the motor 4 nearly equal to the radius thereof will project to the outside of the base portion.

The clutch mechanism shown in FIGS. 4, 11 and 6 operates as follows. In a stationary state in which the torque of the worm is not transmitted to the worm wheel 5, its shaft 51, and the rotary member 8, the engaging member 65 is positioned at an intermediate portion of the valley shaped cam 84. Under this state, the coil spring 63 is not compressed to any appreciable extent so that the engaging member 64 is disengaged from the recess 21 of take-up drum 2 as shown by a portion above the shaft 34 shown in FIG. 4. Hence, in this condition, the drum 2 can rotate without accompanying the clutch member 6 and the rotary member 8. Even when the recess 21 and the opening 62 are located on the lower side so that the engaging member 64 is received in the recess 21, as the take-up drum 2 rotates the engaging member 24 is pushed out of the recess 21 to reach in the range of the clutch member 6, thus permitting the take-up drum 2 to rotate. In other words, when the extended antenna sections 9*a*~9*n* are manually contracted, the wire 1 is pushed into the take-up drum 2 to rotate the drum. In this manner, when the antenna is manually contracted, the wire can be wound about the drum. In the same manner, when the antenna sections are manually extended, the take-up drum 2 is rotated.

In the case of motor drive, where the torque of the worm 44 is transmitted to the rotary member 8 via worm wheel 5, and shaft 51 depending upon whether the motor is driven in the forward direction or reverse direction, either one of the inclined portions 85 rotates in a direction to engage either one of the projections thereby rotating the clutch member 6. This rotation pushes upwardly the engaging member 65 away from the valley shaped cam 84 to compress the spring 63. As a consequence, the engaging member 64 is pushed into the recess 21 so as to rotate the drum 2 together with the clutch member 8. Thus, the torque of the motor 4 is positively transmitted to the take-up drum 2 for automatically contracting the antenna.

The operation of the clutch at the time of contracting the antenna with a motor is as follows:

When the motor is driven while the member 64 shown at a position below shaft 34 in FIG. 4 is being engaged, as a load of a predetermined value, for example 5 Kg, is applied to the motor at the limit of extension or contraction or at any time, the member 64 will further compress the spring 63 to disengage the member 65 from the recess 21. Thus the motor continues to rotate with the clutch disengaged.

With the clutch mechanism shown in FIGS. 4, 11 and 6, it is possible to readily release the clutch for facilitating manual extension and contraction at the beginning thereof, the clutch mechanism being indispensable for stopping the take-up drum at the time of automatically extending and contracting the antenna. This climinates the provision of an independent clutch mechanism for manual operation of the antenna, thus simplifying the construction. For example, at a time of washing a car, while preventing the washing water from entering into the engine room by operating a fan by the continued running of the car engine, the extended antenna can be manually contracted for facilitating the car washing. Of course, the driver can get out of the car to contract the antenna.

The engaging member 64 is always pressed into the recess 21 by spring 63. When this engagement is released manually, the antenna can be extended or contracted. Guide means for taking up the wire between the antenna base cylinder and the take-up drum with the thickness direction of the wire oriented in the radial direction of the take-up drum not only provides an advantageous guide function to the wire at the time of extracting the antenna but also a desirable contact resistance when the extended antenna tends to contract due to the vibration of the car. In other words, the surface of the bent or inclined guide means produces a friction for the wire, thereby preventing contraction of the extended antenna.

Above described connection between the upper end of the wire 1 and the uppermost antenna section 9*a* permits free exchange of the antenna together with the engagement of the spherical portion 16 at the lower end of the wire 1 (see FIG. 11) with circular enlarged groove 38 as well as the sliding of the wire along the groove 38. Of course, the antenna sections 9*a*~9*n* can be exchanged in the same manner.

Where the switch mechanism 90 described above is used, the antenna can be pushed out without causing the wire 1 to twist helically in the antenna base cylinder 7, so that the antenna sections 9*a*~9*n* can be extracted and contracted in proportion to the amount of rotation of the worm wheel 5 or motor 4, thereby decreasing the load thereof. Usually, the switch is opened and the clutch is released to stop the motor when the antenna has been completely contracted or extended so that it has been prohibited to release the clutch or to open the switch before complete extension of the antenna because there is a large probability that the motor is stopped before complete extension of the antenna. Under this condition, the wire 1 is twisted helically. In contrast, where the clutch is released or the switch is opened to stop the motor after the antenna has been completely extended or contracted the load of the motor after complete extension or contraction would become extremely high. This means that the switch is opened under the maximum load after releasing the clutch so that the wire, the mechanism for extending and contracting the antenna and the motor would be subjected to a undue force, thus resulting in wear. According to this invention in which the amount of rotation of the motor or the worm wheel is directly proportional to the amount of extension and contraction of the antenna so that the tendency of twisting the wire in the antenna base cylinder can be prevented and it is possible to forecast the time of complete extension and contraction based on the amount of rotation so as to open the switch before the complete extension, thereby effecting perfect extension or contraction by the inertia of rotation of the motor, worm wheel and the take-up drum. With this measure, undue force and the wear of the mechanism can be avoided after the antenna has been completely extended or contracted. Since the invention enables manual and automatic operations, especially at the time of manually extending the antenna, the antenna can readily be extended by inserting a key into knob at the top of the uppermost antenna section.

In this invention, since a flat wire is used for extending and contracting the antenna, the flexibility of the wire in a direction perpendicular to the flat surface of the wire can be decreased and the take-up property of the flat wire can be improved. Accordingly, it is possible to smoothly take-up and pay out the wire by using a relatively small and compact take-up drum. The flat wire can be stably supported by the supporting walls provided for the drum. Moreover, the wire is maintained in a straight condition in the antenna base cylinder so that the wire can extend and contract the antenna without bending. Accordingly, stable and strong extending and contracting forces can be applied. Moreover any gear or geared pulley or the like driven by the motor is not necessary for operating the wire. Further a large wire guide is also unnecessary, thus simplifying the construction. In spite of the fact that the wire has a substantially rectangular cross-section it manifests a small resistance to the pay out and take-up motions, thus decreasing the necessary driving force.

According to this invention, a flat wire is used, a rotating member driven by a motor is contained in a clutch member concentric with a wire take-up drum, and a cam is provided for the rotary member for causing an engaging member provided for the clutch member to engage and disengage a recess formed on the inner surface of the rotary member, so that at the time of extending and contracting the cam causes the engaging member to fit into the recess for engaging the clutch member so as to obtain automation extending and contracting operations. At the time of manually extending and contracting the antenna, the wire disengages the clutch so that transfer can be made readily between the automatic and manual operations without using any special transfer mechanism, thereby simplifying the construction.

What is claimed is:

1. In an antenna extending and contracting mechanism of the type comprising a rotary drum for taking-up and paying out a relatively rigid wire for extending and contracting said antenna, an electric motor for driving said rotary drum, said antenna being made up of a plurality of telescoped antenna sections, an antenna base cylinder adapted to accommodate said sections when said antenna is contracted, a base member for supporting said rotary drum, said motor and said antenna, clutch means incorporated into a motion transmission system between said motor and said rotary drum, the improvement wherein said wire has a flat rectangular cross sectional configuration having a width of 1.5 to 2.2 times its thickness and four uniform linear surfaces extending along the length of the wire, and one end of said wire is connected to an uppermost antenna section through said antenna base cylinder, and wherein guide means for receiving opposite ends of said wire in the direction of width thereof is interposed between said antenna base cylinder and said rotary drum, said rotary drum being provided with means for edgewisely taking up said wire.

2. The mechanism according to claim 1 wherein edges between flat portions and round end portions of said wire make line contacts against an inner surface of said antenna base cylinder when a push out force is applied to said wire.

3. The mechanism according to claim 1 wherein edge surfaces of said flat wire are arcuate having a radius larger than that of an inner surface of said antenna base cylinder.

4. The mechanism according to claim 1 wherein said means provided for said rotary drum is constructed to helically take up said wire.

5. The mechanism according to claim 1 wherein said means provided for said rotary drum is constructed to spirally take-up said wire.

6. The mechanism according to claim 1 wherein said guide means causes said wire to incline in the width direction and bend said wire to guide it to said take-up drum.

7. The mechanism according to claim 6 wherein said guide means is formed with inclined guide surfaces on the opposite sides thereof and with a flat surface between said inclined guide surfaces for receiving a flat side of said wire and wherein an inner surface of said rotary drum is formed with grooves for edgewisely receiving said wire.

8. The mechanism according to claim 1 which further comprises a motor driven worm wheel, switch means including a gear shaped rotary member actuated by a projection provided for said worm wheel for transmitting the rotation of said worm wheel thereby causing said switch means to start and stop said motor.

9. The mechanism according to claim 1 which further comprises a motor mounting seat formed on one side of an upper surface of said base member, said mounting seat being inclined toward the other side, so as to incline said motor and to contain the same in the range of an upper diameter of said base member.

10. The mechanism according to claim 9 wherein said base member is formed with an internal space starting from said motor mounting space and extending at right angles with respect to a reference surface of said base member.

11. The mechanism according to claim 1 wherein said motor is mounted on substantially the entire surface of a motor mounting seat, said mechanism further comprises a small motor adapted to be mounted on a portion of said motor mounting seat, said motor or said small motor being selectively mounted, and a small worm wheel meshing with a worm wheel driven by said motor said small worm wheel meshing with a worm wheel driven by said small motor.

12. The mechanism according to claim 1 wherein said electric motor is a small motor adapted to be mounted on a portion of a motor mounting seat and to have a small worm wheel operatively situated between a worm of said small motor and a worm wheel contained in said base member.

13. In an antenna extending and contracting mechanism of the type comprising a rotary drum for taking-up and paying out a relatively rigid wire for extending and contacting said antenna, an electric motor for driving said rotary drum, said antenna being made up of a plurality of telescoped antenna sections, an antenna base cylinder accommodating said sections when said antenna is contracted, a base member for supporting said rotary drum, said motor and said antenna, clutch means incorporated into a motion transmission system between said motor and said rotary drum, the improvement wherein said wire has a flat rectangular cross sectional configuration having a width of 1.5 to 2.2 times its thickness, and one end of said wire is connected to an uppermost antenna section through said antenna base cylinder, and wherein guide means for receiving opposite ends of said wire in the direction of width thereof is interposed between said antenna base cylinder and said rotary drum, said rotary drum being provided with means for edgewisely taking up said wire, further comprising an engaging member secured to one end of said flat wire, and wherein a groove is provided for a peripheral surface of said rotary drum for receiving said engaging member, the diameter of said groove being increased in a direction of depth thereof, whereby after inserting said guide means into said groove as said rotary drum is rotated, said guide means is received in said increased diameter portion of said groove.

14. The mechanism according to claim 13 wherein said guide means secured to one end of said flat wire helically guides said wire to a peripheral surface of said rotary drum.

15. The mechanism according to claim 13 wherein said guide means secured to said wire is moved in a direction of depth of said increased diameter groove as the amount of said wire taken up by said rotary drum varies.

16. The mechanism according to claim 13 further comprising a clutch member provided for said base member, concentric with said rotary drum, a rotary member driven by said motor, and a cam provided for said rotary member for reciprocating an engaging means formed in said clutch member toward and away from an inner surface of said rotary drum.

17. The mechanism according to claim 16 further comprising a worm formed on a motor driven shaft at a central poriton of said base member, a worm wheel meshing with said worm, a shaft projecting from said worm wheel for pivotally supporting said rotary drum, and an engaging portion 82 formed in a shaft opening of said rotary member for engaging said shaft thereby driving said rotary member with said motor.

18. The mechanism according to claim 16 wherein said clutch member is provided with a first engaging device cooperating with a recess of said rotary drum, a second engaging device cooperating with a cam of said rotary member, and a spring interconnecting said first and second engaging devices.

19. The mechanism antenna according to claim 16 which further comprises spring means concentric with said base member and urged against a peripheral surface of said clutch member, said spring means transmitting the torque of said rotary member to said clutch member.

20. The mechanism according to claim 16 wherein said clutch member is formed as an elongated rectangular form with an opening at a central portion of said clutch member for loosely receiving a shaft projecting from said motor driven worm wheel, said clutch member being provided with an opening extending between longer sides of said clutch member at right angles with respect to said opening for loosely receiving said shaft.

21. The mechanism according to claim 16 wherein said rotary drum is formed with wire receiving grooves on its inner surface for helically taking up said wire, a chamber is formed inside of said wire receiving grooves for containing said clutch member and said rotary member, and wherein a projection is provided for a side wall of said chamber for cooperating with said engaging means provided for said clutch member.

22. The mechanism according to claim 16 wherein said rotary drum comprises a circular disc shaped member on one side surface, with a wire receiving groove for spirally receiving said wire and with annular projecting walls on the other surface to form a recess for containing said clutch member and said rotary member, and wherein a member for engaging said engaging means of said clutch member is provided for an inner wall of said annular projecting walls.

23. The mechanism according to claim 22 wherein a partition plate is provided at an opening to said groove for spirally receiving said wire, said partition plate being provided with a recess for leading said wire over an entire range in which said groove is formed.

24. The mechanism according to claim 16 wherein a cam is formed at a center side surface of said rotary member, and a shoulder is provided to cooperate with a pair of projections formed on both sides of a shaft opening of said clutch member.

* * * * *